United States Patent [19]

Wakayama et al.

[11] 4,302,696

[45] Nov. 24, 1981

[54] GAMMA-RAY COMPENSATED IONIZATION CHAMBER

[75] Inventors: Naoaki Wakayama, Tokai; Toshimasa Tomoda; Shinji Fukakusa, both of Amagasaki, all of Japan

[73] Assignees: Mitsubishi Denki Kabushiki Kaisha; Japan Atomic Energy Research Institute, both of Tokyo, Japan

[21] Appl. No.: 56,265

[22] Filed: Jul. 10, 1979

[30] Foreign Application Priority Data

Jul. 19, 1978 [JP] Japan ..... 53-88150

[51] Int. Cl.[3] ..... H01J 47/02; H01J 47/08

[52] U.S. Cl. ..... 313/93; 250/272

[58] Field of Search ..... 313/93, 61 D

[56] References Cited

U.S. PATENT DOCUMENTS 3,414,726 12/1968 Chameroy ..... 313/93 X

*Primary Examiner*—Robert Segal

*Attorney, Agent, or Firm*—Oblon, Fisher, Spivak, McClelland & Maier

[57] ABSTRACT

A gamma-ray compensated ionization chamber having cylindrical multiplex electrodes comprises first cylindrical multiplex electrodes and second cylindrical multiplex electrodes being arranged in reverse orders to that of the first cylindrical multiplex electrodes in the longitudinal direction of the cylindrical electrodes to prevent the deterioration of compensating characteristics caused by the variation of an external temperature and variation of gamma-ray spectrum.

5 Claims, 2 Drawing Figures

GAMMA-RAY COMPENSATED IONIZATION CHAMBER

BACKGROUND OF THE INVENTION

1. Field of the Invention:

The present invention relates to a gamma-ray compensated ionization chamber. More particularly, it relates to a gamma-ray compensated ionization chamber in which the variation of the compensating characteristics caused by the variation of the external temperature and the variation of the gamma-ray energy is reduced.

2. Description of the Prior Arts:

The ionization chamber shown in FIG. 1 has been known.

In FIG. 1, a cylindrical signal electrode (2) is coaxially placed outside of the cylindrical compensation electrode (1). A high voltage cylindrical electrode (3) is coaxially placed outside of the signal electrode (2). The high voltage electrode (3), the compensation electrode (1) and the signal electrode (2) are combined to form multiplex electrodes (4). The electrodes (1), (2), (3) are held in a metal casing being an airtight container. A neutron sensitive substance (6) such as boron and uranium (the reference (6*a*) is in the side of the high voltage electrode; and (6*b*) is in the side of the signal electrode (2)) is coated on the inner surface of the high voltage electrode (3) and on the external surface of the signal electrode (2). The casing (5) is electrically insulated from the high voltage electrode (3) through a ring insulator (7*a*) which holds the electrodes in place. The high voltage electrode (3) is electrically insulated from the signal electrode (2) through the ring insulator (7*b*). The signal electrode (2) is electrically insulated from the compensation electrode (1) through the ring insulator (7*c*). They are coaxially held. The insulators (7*a*), (7*b*), (7*c*) are designated by the reference numeral (7). The electrodes (1), (2), (3) are respectively and electrically connected through the terminals (8) placed outside of the casing (5). The terminal (8) comprises a compensation electrode output terminal (8*a*), the signal electrode output terminal (8*b*) and the high voltage electrode output terminal (8*c*). The compensation electrode (1) is electrically connected through a lead wire (9*a*) to the compensation electrode output terminal (8*a*). The signal electrode (2) is electrically connected through the lead wire (9*b*) to the signal electrode output terminal (8*b*). The high voltage electrode (3) is electrically connected through the lead wire (9*c*) to the high voltage electrode output terminal (8*c*). The lead wires (9*a*), (9*b*), (9*c*) are designated by the reference numeral (9). An ionizable gas (10) for ionizing between the electrodes (1), (2), (3) is sealed inside of the casing. A small hole (H) is formed on each of the end surfaces of the cylindrical electrodes (1), (2), (3) at the reverse side to the terminals (8) and the ionizable gas (10) is freely moved through the small holes (H). Each end surface having each small hole (H) is formed in one body with the cylindrical part of each electrode.

The condition in which the radioactive ray radiates into the ionization chamber having said structure will be illustrated.

The ionizable gas (10) between the compensation electrode (1) and the signal electrode (2) is ionized by the radiation of the radioactive ray thereby forming secondary electrons emitted from the surface of the electrode by gamma-ray. Moreover, a part of the gamma-ray directly actuates the ionizable gas to cause ionization. When negative voltage is applied to the compensation electrode (1), the ionization $I_\gamma$ is passed from the signal electrode (2) to the compensation electrode (1). The ionization is also caused by the gamma-ray between the signal electrode (2) and the high voltage electrode (3) the same as between the signal electrode (2) and the compensation electrode (1). The neutron sensitive substance (6*a*), (6*b*) reacts with neutrons whereby the ionizable gas is ionized by the resulting charged particles at high velocity. Therefore, when the positive voltage is applied to the high voltage electrode (3), the neutron current $I_n$ being proportional to the intensity of neutron and gamma-ray ionization current $I_\gamma$, being proportional to the intensity of the gamma-ray, are passed from the high voltage electrode (3) to the signal electrode (2). Thus, the signal current $I_s$: $I_s = I_n + I_\gamma' - I_\gamma$ is passed to the signal electrode (2).

The currents $I_\gamma$ and $I_\gamma'$ caused by the gamma-ray are proportional to the surface area of the electrodes and the number of the molecules of the ionizable gas between the electrodes. The condition of almost $I_\gamma' = I_\gamma$ can be given by selecting the diameter of the electrodes. In such case, the signal current $I_s$ is proportional to the neutron beam as the signal current $I_s$ = neutron current $I_n$.

As described above, the purpose of the ionization chamber is to offset (cancel) the gamma-ray current and to obtain only neutron current $I_n$.

In this type of ionization chamber, it takes a long time for heat conduction into inside part depending upon the variation of the external temperature, to cause the temperature difference between the inner part and the external part. The ratio of spaces between the electrodes varies depending upon the difference of the thermal expansions to cause the difference between the gamma-ray currents to be $I_\gamma' \neq I_\gamma$. Therefore, the error results since the signal current $I_s$ varies from the neutron current $I_n$ for the gamma-ray currents $I_\gamma$, $I_\gamma'$.

When the gamma-ray having different energy is radiated, the gamma-ray shielding coefficient by the electrode varies depending upon the energy i.e. the wavelength. Therefore, the intensity of the gamma-ray reaching the inside of the ionization chamber varies depending upon the energy of the gamma-ray. The gamma-ray ionization current between the electrodes varies depending upon the wavelength to cause a change of the gamma-ray compensation, disadvantageously.

SUMMARY OF THE INVENTION

It is an object of the present invention to provide a gamma-ray compensated ionization chamber wherein cylindrical multiplex electrodes comprising a cylindrical high voltage electrode, a signal electrode and a compensation electrode which are coaxially arranged, are divided into at least two sections in the axial direction, and the arrangement of the electrodes in the radial direction in one section is reversed in the other section to reduce the variation of the compensation characteristic caused by the variation of the environmental temperature and the variation of the gamma-ray energy.

It is another object of the present invention to provide a gamma-ray ionization chamber having a divided structure of the cylindrical multiplex electrodes in the axial direction wherein the arrangement of electrodes in the radial direction is reversed in each other section and the corresponding electrodes in the sections are electrically connected in a casing to reduce the variation of the compensation characteristics and to reduce the number of power sources for applying power to the electrodes.

The gamma-ray compensated ionization chamber of the present invention will be further illustrated.

DETAILED DESCRIPTION OF THE PREFERRED EMBODIMENTS

Figure 1:
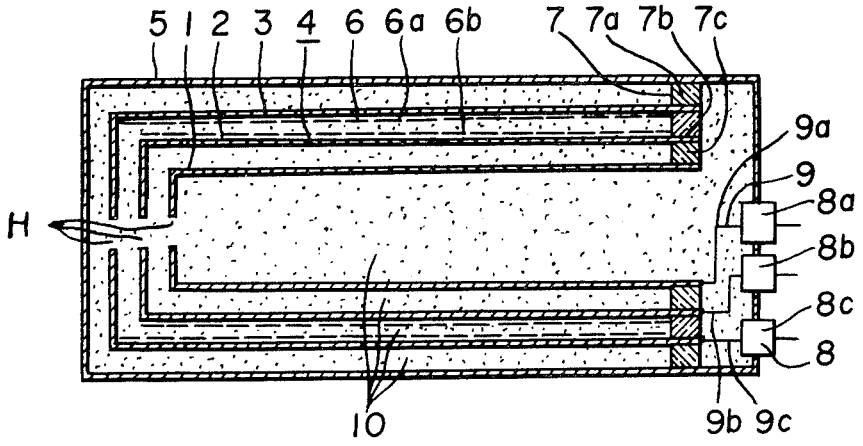
FIG. 1 PRIOR ART
FIG. 1 is a sectional schematic view of a conventional gamma-ray compensated ionization chamber.
Figure 2:
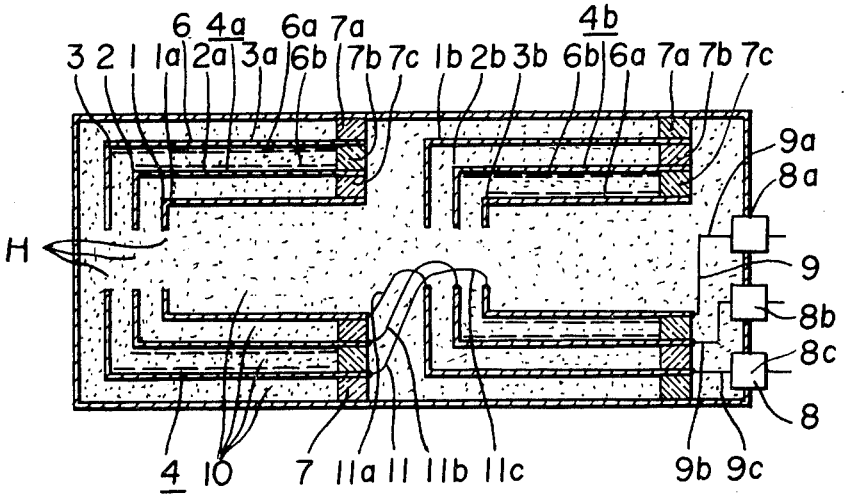
FIG. 2 is a sectional schematic view of one embodiment of a gamma-ray compensated ionization chamber.

In FIG. 2, the identical and corresponding parts to those of FIG. 1 are designated by the same reference numerals. The description of such parts is not repeated.

FIG. 2 shows one embodiment of the cylindrical multiplex electrodes which comprises two sections of multiplex electrodes. The left multiplex electrodes (hereinafter referring to the first multiplex electrodes) (4*a*) are arranged in the same structure as that of FIG. 1. The right multiplex electrodes (hereinafter referring to the second multiplex electrodes) (4*b*) are arranged in the reversed arrangement of the high voltage electrode and the compensation electrode to those of the first multiplex electrode (4*a*). The sizes of the electrodes are substantially the same.

In FIG. 2, the cylindrical compensation electrode (1*b*) is insulated by the ring insulator (7*a*) from the casing (4). The signal electrode (2*b*) is coaxially placed inside of the compensation electrode (1*b*) and is insulated by the ring insulator (7*b*) from the compensation electrode (1*b*). The high voltage electrode (3*b*) is coaxially placed inside of the signal electrode (2*b*) and is insulated by the ring insulator (7*c*) from the signal electrode (2*b*).

The compensation electrode (1*b*), the signal electrode (2*b*) and the high voltage electrode (3*b*) form the second cylindrical multiplex electrodes (4*b*). The first and second cylindrical multiplex electrodes (4*a*), (4*b*) are arranged to have the common central axis. The neutron sensitive substance (6*b*) is coated on the inner surface of the signal electrode (2*b*). The neutron sensitive substance (6*a*) is coated on the outer surface of the high voltage electrode (3*b*). The multiplex electrodes (4*a*), (4*b*) are electrically connected by connecting wires (11) inside of the casing (5). The connecting wires (11) comprise a wire (11*a*) for connecting both of the compensation electrodes (1*a*), (1*b*); a wire (11*b*) for connecting both of the signal electrodes (2*a*), (2*b*) and the wire (11*c*) for connecting both of the high voltage electrodes (3*a*), (3*b*). The compensation electrode (1*b*), the signal electrode (2*b*) and the high voltage electrode (3*b*) are electrically connected to, respectively, the compensation electrode output terminal (8*a*), the signal electrode output terminal (8*b*) and the high voltage electrode output terminal (8*c*) by the lead wires (9*a*), (9*b*), and (9*c*).

The principle of the operation of the ionization chamber of FIG. 2, is substantially the same as that of FIG. 1 except in the following matters. In the ionization chamber of FIG. 1, when the external temperature varies the ratio of the spaces between the electrodes varies by the difference between the inner temperature and the external temperature to cause the variation of the gamma-ray current whereby the compensation characteristics vary. On the other hand, in the ionization chamber of FIG. 2, the arrangement of the electrodes in the first multiplex electrodes (4*a*) is in reversal of the arrangement of the electrodes in the second multiplex electrodes (46). Therefore, the variation of the ratio of spaces between the electrodes of the first multiplex electrodes can be offset by that of the electrodes of the second multiplex electrodes. The variation of the compensating characteristics can be reduced.

When the gamma-ray having different energy is radiated, the ionization current between the electrodes varies depending upon the energy of the radiated gamma-ray. The variation between the electrodes in one section can be offset by that of the electrodes in the other section to reduce the variation of the compensating characteristics.

In this embodiment, the electrodes for both of the multiplex electrodes (4*a*), (4*b*) are electrically connected inside of the casing (5) whereby the number of the power sources applying power to the electrodes can be advantageously minimized.

In such embodiments, two multiplex electrodes (4*a*), (4*b*) having substantially the same sizes of electrodes as in the two divided system have been illustrated. Thus, multiplex electrodes divided into many sections can be used to impart the same effect.

It is also possible to separately form the first cylindrical multiplex electrodes arranged in order of the high voltage electrode, the signal electrode and the compensation electrode in one casing and to form separately the second cylindrical multiplex electrode arranged in order of the compensation electrode, the signal electrode and the high voltage electrode in the other casing and to connect them.

It is also possible to form separately third and following cylindrical multiplex electrodes in reverse order to each other in each casing and to electrically connect them.

We claim:

1. A gamma-ray compensated ionization chamber which comprises cylindrical multiplex electrodes consisting of a cylindrical high voltage electrode, a cylindrical signal electrode and a cylindrical compensation electrode which are coaxially located with respect to a casing holding said multiplex electrodes and containing an ionizable gas in a sealed condition between the electrodes, an improvement characterized in that said cylindrical multiplex electrodes are divided at a midpoint in the length of said cylindrical multiplex electrodes into at least two sections of multiplex electrodes; one of said at least two sections being arranged so that the high voltage electrode thereof is located adjacent the casing and the compensation electrode thereof is located adjacent the axis of said casing, and the other of said at least two sections being arranged so that the compensation electrode is located adjacent the casing and the high voltage electrode is located adjacent the axis of said casing.

2. A gamma-ray compensation ionization chamber according to claim 1 wherein the at least two sections of cylindrical multiplex electrodes are electrically connected inside of the casing.

3. A gamma-ray compensated ionization chamber according to claim 1 or 2, wherein the electrodes in the at least two sections of cylindrical multiplex electrodes are respectively held with ring insulators for insulating each of the electrodes from each other.

4. A gamma-ray compensated ionization chamber according to claim 3 wherein the cylindrical multiplex electrodes in one of the at least two sections are electrically connected to, respectively, external terminals at the ends of the electrodes which are insulated and held with the ring insulators.

5. A gamma-ray compensated ionization chamber according to claim 3 wherein the electrodes for the at least two sections of cylindrical multiplex electrodes have respectively end surfaces with each having a small hole therein which is respectively formed in one piece with each of the cylindrical parts of the electrodes at the reverse side to the insulated ends.

* * * * *